United States Patent [19]

McLaughlin

[11] Patent Number: 4,893,806

[45] Date of Patent: Jan. 16, 1990

[54] PINCH ROLLER DEVICE

[75] Inventor: Thomas McLaughlin, Ossining, N.Y.

[73] Assignee: Technical Support Services, Inc., Ossining, N.Y.

[21] Appl. No.: 223,355

[22] Filed: Jul. 25, 1988

[51] Int. Cl.[4] ..... B65H 5/02

[52] U.S. Cl. ..... 271/272

[58] Field of Search ..... 271/272, 273, 274, 9, 271/263

[56] References Cited

U.S. PATENT DOCUMENTS

| | | | |
|---|---|---|---|
| 4,154,437 | 5/1979 | Butcher | 271/263 X |
| 4,511,133 | 4/1985 | Kokubo | 271/9 X |
| 4,518,158 | 5/1985 | Goi | 271/9 |

*Primary Examiner*—Richard A. Schacher

*Attorney, Agent, or Firm*—Levisohn, Lerner & Berger

[57] ABSTRACT

A pinch roller is be retrofitted to existing automatic teller machines (ATMs) to eliminate misfeeding of deposit envelopes. The pinch roller is secured between the frame members for the conveyor belts which serve to transport the envelopes. The pinch roller mechanism can be adapted to the ATMs without the necessity of drilling new holes into the frame members since an existing hole (previously unused) and a bolt are used for securing the pinch roller mechanism. Specifically, the pinch roller is located between the frame members above the foam-like drive roller for the conveyor belt. A pinch roller axle, in the form of a hex-head bolt having its other end provided with internal screw threads, passes through an aperture already existing in one of the frame members and is secured to an exposed bolt, securing a motor housing to the frame members. Also, the pinch roller is chamfered on its ends to facilitate ease of insertion between the frame members. The pinch roller axle is also chamfered and is adapted to be received in the aperture for the bolt holding the motor housing to the frame member. The length of the pinch roller is such as to permit slight lateral movement of the pinch roller to facilitate visual alignment of the pinch roller axle and its internal threading onto the exposed bolt holding the housing to the frame member. The pinch roller, when properly secured between the frame members, serves to provide sufficient back pressure to the foam-like drive roller for the conveyor belt so that any slack is eliminated and even extremely bulky envelopes are properly fed through the conveyor belts.

6 Claims, 2 Drawing Sheets

PINCH ROLLER DEVICE

BACKGROUND OF THE INVENTION AND DESCRIPTION OF THE PRIOR ART

The present invention relates to a mechanism for use in connection with an automatic teller machine (ATM) to eliminate misfeeds and/or jamming of the deposit envelopes as they are fed into the machine. Specifically, the present invention is intended to be retrofitted into existing ATMs which now experience misfeeds and/or jamming of deposit envelopes and, in addition, it is intended that the pinch roller mechanism be incorporated into the design of newly manufactured automatic teller machines. Whether the automatic teller machines are originally provided with the mechanism of the present invention, or, alternatively, if the automatic teller machines are retrofitted with the pinch roller device, disclosed herein, the jamming and/or misfeed difficulties otherwise occurring from time to time when deposit envelopes are fed into the automatic teller machine are substantially eliminated. Service calls to maintenance workers are correspondingly, severely reduced.

Automatic teller machines are today in widespread use and enable banking customers to perform a variety of banking transactions, at any time of the day or night without the necessity of the bank providing individual tellers. These machines typically allow bank account information to be displayed to the customer, allow for the customer to withdraw cash, if desired, and, importantly, with respect to the present invention, allow the deposit of funds into the safety and security of the bank. These deposits, cash and/or checks, are placed into an envelope and the automatic teller machine, having a front-opening slot, receives from the depositor the front end of the envelope. Then the envelope is drawn through the deposit slot and into the machine. These envelopes often have a great deal of cash and/or checks in them and their thickness can lead to misfeeding and/or jamming of the infeed mechanism.

ATMs and specifically those manufactured and distributed by the Diebold Corporation are in widespread use. As mentioned, these machines include a mechanism for selectively receiving deposit envelopes of significant bulk. The deposit envelope mechanisms of existing ATMs generally include a pair of opposed conveyor belts of about 18′ in length. The envelope sought to be deposited by the banking customer is drawn into the ATM by the envelope's leading edge being placed between the opposed conveyor belts and, then, a motor is automatically energized which causes the conveyor belts to rotate and thereby draw the envelop into the ATM. The conveyor belts are driven by either one or a pair of foam-like drive rollers which physically contact the underside surface of the conveyor belts and cause the conveyor belts to rotate in the desired infeed direction. These foam-like drive rollers are driven by an electrically powered drive motor.

In the summertime for the northern states of the United States and basically year-round in many of the southern states, high humidity causes the conveyor belts to become quite stiff. This results in the conveyor belts slipping with respect to the foam-like drive rollers. This results in deposit envelope misfeeds and/or jamming of the mechanism. In addition, simple aging of the conveyor belts and variations in the temperature/humidity conditions cause a tendency for the belts to slip. This, too, causes skewing and misfeeds of the envelopes and results in "deposit jam" failures in the machine. When this happens, the banking facility must shut down the ATM, resulting in inconvenience and annoyance to the bank's customers and the loss of access to these ATM devices. Further, the bank must call a service representative for repair of the machine. This is clearly expensive and results in significant down time for the ATM. The service representative for the machine replaces the entire modular linear depository assembly with a new assembly and then the machine is started up once again for banking transactions. While the present invention relates to all linear depository assemblies of ATMs, it has specific applicability to the envelope transfer belts in the linear depository assembly of the Diebold 910 Automatic Teller Machine. The present invention can be provided as a retro-fit mechanism for eliminating deposit jams from existing, in-the-field, machines or, alternatively, the present invention can be adapted for new ATMs. When so equipped, the ATMs will be capable of receiving thick deposit envelopes without deposit jam, independent of the temperature/humidity conditions and independent of the age of the belts. This clearly results in significant cost savings to the banking institutions, eliminates frequent service calls, eliminates the requirement for linear depository assemblies to be frequently replaced and serves the bank and its customers by maintaining the machines, in full operational capability, 24 hours of the day.

SUMMARY OF THE INVENTION

The linear depository assemblies of the ATMs generally include a pair of identically machined, upwardly extending frame members which support therebetween the rotating axles for the foam-like drive roller(s) and the bearing axle for the conveyor belts. The frame members are identically machined in order to facilitate ease of fabrication and assembly of the machine. A drive motor is secured on one side of one of the frame members and a housing to protect the drive motor is generally also bolted to that frame member. The bolt with a nut secures the motor housing to the frame member. It is closely adjacent to the foam-like drive roller for the conveyor belts since the foam-like drive roller is secured to the drive shaft of the motor, secured within the motor housing. The present invention utilizes the bolt, which has previously been used for securing the motor housing to the frame member and, in addition, the aperture in the other frame member, corresponding to the bolt hole for the motor housing, which is located directly opposite to the hole through which the bolt is inserted for securing the motor housing to the first frame member. A pinch roller is located directly above the foam-like drive roller of the existing linear depository assembly which pinch roller provides downward pressure onto the conveyor belt. The pinch roller presses against the conveyor belt to provide back pressure. This, then, facilitates the ability of the rear foam-like drive roller to pull the conveyor belt, irrespective of temperature/humidity or age of the belt. The motion of the belt will be smooth and will efficiently receive the deposit envelope.

The pinch roller is supported by a bolt which serves as its free bearing axle. The bolt is inserted through the aperture, as mentioned, in the hole of the frame member opposite to that which secures the motor housing to the first frame member. The bolt, which is inserted through the frame member and then through the central longitudinal axis of the pinch roller, has its chamfered end received within the aperture of the frame member which has been provided for the bolt which secures the motor housing. The bolt or axle for the pinch roller is provided with an internally threaded end portion which matingly engages the exposed bolt (the nut having been discarded), formerly holding the motor housing to the first frame member. In this manner, the pinch roller is supported on the frame members on a bolt axle, one end of which is threaded onto the bolt used for securing the motor housing and the other end of which is inserted through the existing aperture of the other frame member.

Thus, a pinch roller, directly above the foam-like drive roller, is provided which eliminates misfeeds and jamming of deposit envelopes and eliminates the problems otherwise occurring due to the aging and temperature/humidity conditions of the conveyor belt. The pinch roller can be adapted to existing ATM machines, and specifically, the Diebold 910 Automatic Teller Machine without the necessity of drilling new holes since the frame member is already provided with an unused aperture, corresponding to the aperture for the bolt for the motor housing. This, as mentioned, is because the two frame members are identically fabricated and machined to efficiently and economically facilitate manufacturing. The pinch roller, when assembled into the linear depository assembly, is absolutely parallel to the rotating axis of the foam-like drive roller and can not be skewed since one end is firmly held in the aperture for the bolt holding the motor housing to the frame member. The pinch roller is a significant advance in that it is relatively inexpensive yet eliminates significant machine problems and the expenditure of time and money on repairs. In addition, the pinch roller, while it extends substantially across the width of the conveyor belt to provide relative uniform tension thereacross, it is slightly less than the distance between the inside walls of the frame members so that the pinch roller, upon being retro-fit into existing ATMs, can be laterally shifted over to second frame member (the one which is not provided with the motor and the motor housing) to facilitate alignment of the internally threaded end of the bolt or axle of the pinch roller with the exposed threads of the bolt holding the motor housing. Thus, the pinch roller and supporting bolt can be installed with relative ease in a minimum of time.

DETAILED DESCRIPTION OF THE DRAWINGS AND THE PREFERRED EMBODIMENT

Figure 1:
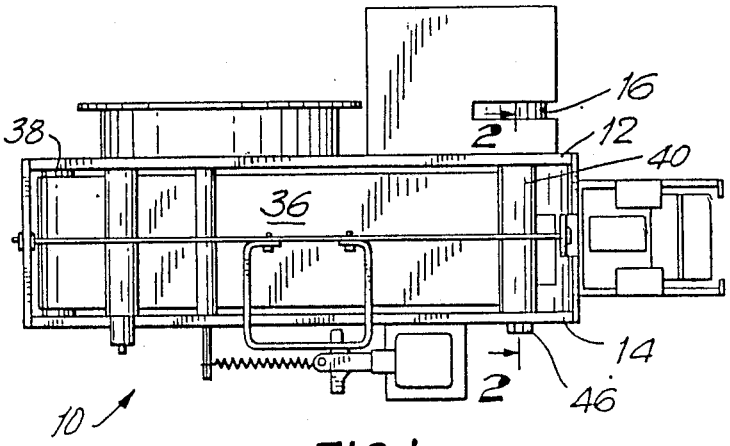
FIG. 1 is a top-plan view showing the present invention retro-fitted into the linear depository mechanism of an ATM.

The linear depository assembly 10 comprises a pair of longitudinally extending, parallel and identically fabricated or machined metallic frame members 12 and 14. A plurality of apertures are machined into the frame members prior to assembly and the two frame members 12 and 14 are identically pre-drilled so that the assembly procedure is quickly and easily performed. The assembly technician need not worry about which frame member is for which side, since they are identically fabricated.

A drive motor 16 has a rotating output shaft 18 on which a foam-like drive roller 20 is secured. The drive motor 16 is protected by a motor housing 22. The motor housing 22 is bolted to the first frame member 12 by a bolt 26 passing through a flange 24. The bolt 26 has a head 28 and an exterior threaded body portion 30. The bolt 26 is originally secured through frame member 12 by a nut 32 (not shown). When the pinch roller assembly of the present invention is retro-fitted onto an existing ATM machine, the nut 32, secured around and matingly engaged with the screw-threaded body 30, is removed and discarded. This, then, exposes the screw-threaded body 30 for receipt of the pinch roller axle 34, as will be more fully described hereinafter.

A conveyor belt 36, of the endless type, is wrapped around, on one end, the foam-like drive roller 20 and is driven thereby. Of course, another rotatable bearing or drive mechanism 38 is provided for the other end of the conveyor belt 36. A second conveyor belt 37 is provided directly below the first conveyor belt 36 and it, too, can either be driven by a drive motor (not shown) and foam-like drive roller 39 or, alternatively, it can be of a free wheeling roller. The leading edge of a deposit envelope containing checks or cash is inserted between the conveyor belts 36 and 37 and when the drive motor 16 is energized, causing the foam-like drive roller 20 to rotate, the envelope is drawn into the ATM by the movement of the conveyor belt 36 with respect to the other belt 37. However, as has been previously explained, when temperature and humidity conditions or mere aging of the belt reach a certain level, the conveyor belt 36 tends to slip, causing misfeeding and jamming of the envelopes. The pinch roller mechanism of the present invention, however, serves to eliminate the misfeeding and jamming and the expensive solutions to those problems.

The pinch roller 40 is made from a Delrin like material, machined from a rod of about one inch in outside diameter. Its circumferential edges 42 are chamfered at about 60 degrees for about 0.050 inches. The interior diameter of the bore 43 of the pinch roller 40 is about 0.323 inches and, of course, extends along the entire length of the pinch roller. A pinch roller axle 34 in the form of a bolt with a hex head 46 is provided. It has a cylindrical shaft portion 48. The outside diameter of the shaft portion 48 is about 0.312 inches and, thus, forms a support shaft for free rotation of the pinch roller 40.

Figure 2:
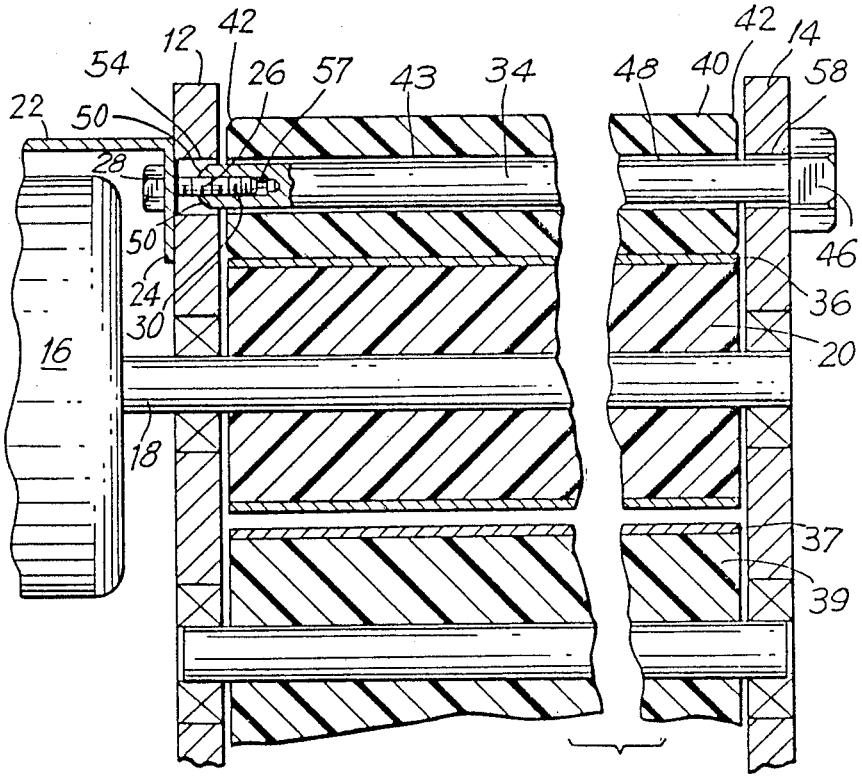
FIG. 2 is an enlarged, partial cross-sectional view of the invention, showing the mechanical interrelationship between the pinch roller axle, pinch roller, the frame members, and the bolt holding the motor housing.
Figure 3:
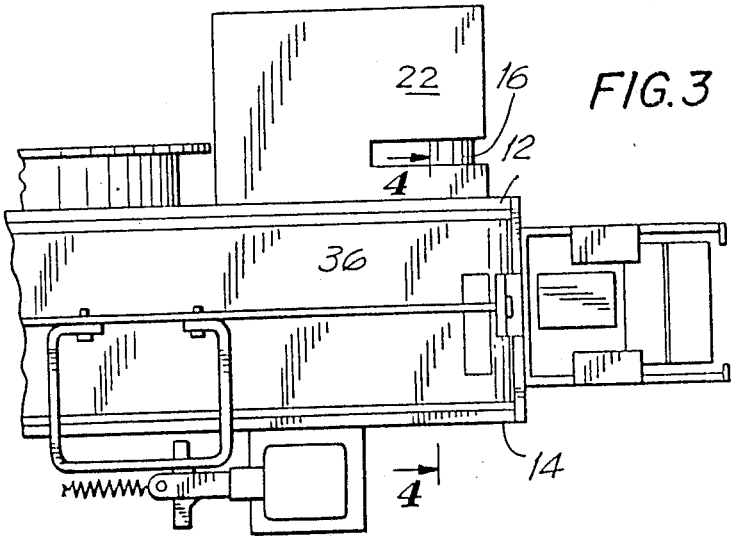
FIG. 3 is an enlarged, partial top plan view of the linear depository mechanism of an ATM, shown in its original configuration, i.e. without having been retrofitted with the subject invention.
Figure 4:
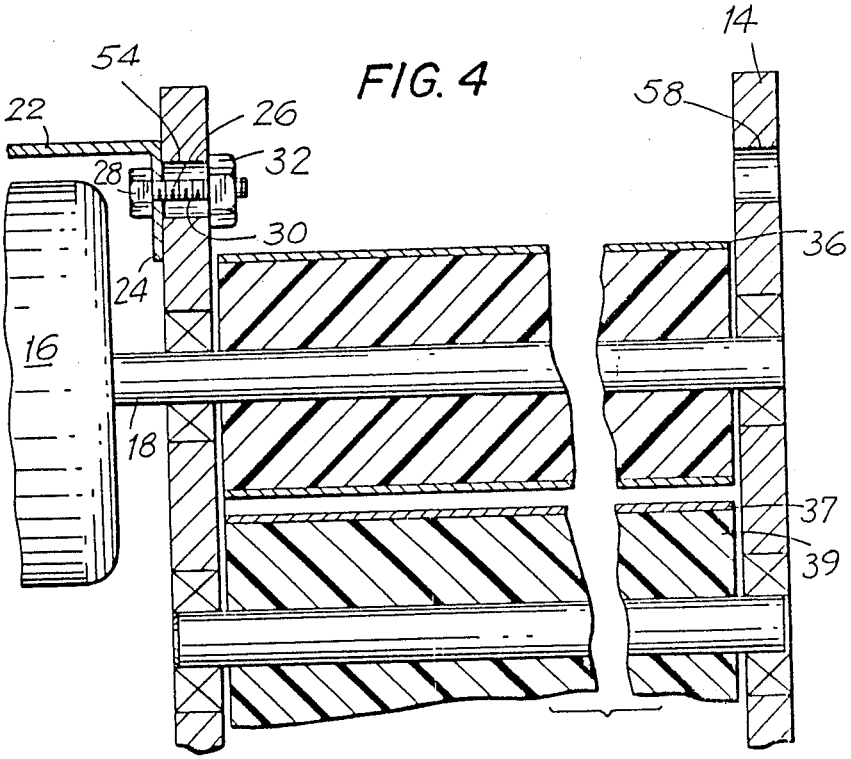
FIG. 4 is a partial cross-sectional view taken generally along the line 4—4 of FIG. 3.

The front end 50 of the pinch roller axle 34 is chamfered at about 45 degrees for about 0.050 inches. The front portion 50 is also provided with internal screw-threads 57 extending for about 0.875 inches. The threads are matingly engagable with the existing external screw-threads of the screw-threaded body 30 of the bolt 26 serving to secure the motor housing 22. Preferably, the screw-threads are 10/32 of an inch which correspond to the pitch of the existing bolt 26. The chamfered end 50 of the pinch roller axle 34 is adapted to be matingly received within the aperture 56 passing through first frame member 12 (see FIG. 2). This, too, facilitates the absolute, perfect parallelism between the pinch roller axle 34, the pinch roller 40, and the foam-like drive roller 20, secured for rotation on output shaft 18.

The length of the pinch roller 40 is such that upon its assembly, between the frame members 12 and 14, the pinch roller can be slid toward frame member 14 to enable visual alignment between the front end 50 of the pinch roller axle 34, and the threaded end or screw-threaded body 30 of bolt 26.

To retro-fit an existing Diebold 910 Automatic Teller Machine, the serviceman will first remove and discard the nut which has been threadingly engaged on the screw-threaded body 30 of bolt 26, serving to secure the motor housing 22 to frame member 12. Then, the pinch roller is inserted between frame members 12 and 14 by having the bore 43 first placed over the screw-threaded body 30 of the bolt 26. To this end, the circumferential, chamfered end 42 facilitates the insertion of the pinch roller into place since the dimensioning of the part is rather exacting and "play" between the elements is preferably diminished. With the pinch roller in place, the pinch roller axle 34 is inserted through frame member 14 by having its front chamfered portion 50 first inserted through the aperture 58 in frame member 14, that aperture corresponding precisely to aperture 56 of frame member 12. The chamfered end 50 of the pinch roller axle 34 passes through bore 43 of the pinch roller. The technician can then simply slide the pinch roller 40 toward frame member 14 to facilitate visual alignment between the internal threads 57 of the pinch roller axle 34 and the exposed threads of the screw threaded body 30 of bolt 26. The internally-threaded front portion 57 of the pinch roller axle 34 is then threadingly engaged onto the screw-threaded body 30 of bolt 26 until the chamfered end of the pinch roller axle is received within aperture 56 of the frame member 12. The hex head 46 of the pinch roller axle 34 ca then be further tightened, but it should not be over tightened.

Thus, a pinch roller assembly is rotatably secured directly above the foam-like drive roller 20 for the conveyor belt 36. In this manner, the assembly provides a downward pressure against the conveyor belt, i.e., a back pressure on the belt, which facilitates the smooth, even motion of the belt, driven by the foam-like drive roller, independent of the belt's age condition and the temperature and/or humidity conditions. The entire retro-fitting of existing Diebold 910 Automatic Teller Machines has been easily accomplished, in a minimum of time, without the necessity of drilling additional holes in the frame members 12 and 14. Rather, however, the existing bolt 26, used for securing the motor housing 22 to the frame member 12, supports one end of the pinch roller axle 34 while the apertures 56 and 58 of the first and second frame members 12 and 14, respectively, drilled during fabrication of the frame members support the pinch roller axle. Aperture 58 is normally unused in existing ATMs.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A method of correcting misfeeding of deposit envelopes in an Automatic Teller Machine having a pair of opposed, endless deposit envelope conveyor belts travelling between a pair of first and second identically fabricated frame members, said deposit envelopes being drawn into said machine by movement of said conveyor belts with respect to one another, at least one of said conveyor belts being driven by a foam-like drive roller itself rotatably driven by a motor located outside of said frame members, said motor having a housing secured by a bolt and nut passing through a first aperture in a first of said frame members, comprising the steps of:

(a) removing said nut from said bolt to expose the threads of said bolt;

(b) locating a pinch roller between said frame members, above said foam-like drive roller;

(c) locating a pinch roller axle through a second aperture of said second frame member corresponding in position to said first aperture;

(d) locating said pinch roller axle through said pinch roller; and (e) securing said pinch roller axle to said exposed threads of said bolt such that said pinch roller bears down on one of said conveyor belts against said foam-like drive roller.

2. A method as claimed in claim 1, further comprising the step of locating one end of said pinch roller axle in said first aperture.

3. In an Automatic Teller Machine, having a linear deposit envelope receiving mechanism comprising:

(a) a pair of opposed first and second identically fabricated frame members;

(b) a pair of opposed conveyor belts supported for movement between said frame members, said deposit envelopes being drawn into said machine by movement of at least one of said conveyor belts with respect to the other;

(c) at least one foam-like drive roller, rotatably secured between said frame members, adapted to engage and rotate at least one of said conveyor belts to move the same;

(d) a motor means, located outside of said frame members, for selectively driving said foam-like drive rollers; and (e) a housing for said motor means secured by a bolt and a removable nut, which exposes the end of said bolt when removed, to a first aperture of a first of said frame members;

a mechanism for correcting misfeeding of deposit envelopes comprising;

(i) a pinch roller, located between said frame members and of sufficient size so as to create frictional engagement between one of said conveyor belts and said foam-like drive roller; and (ii) a pinch roller axle, passing through a second aperture of the second of said frame members, said first and second apertures being mirror images of one another, said pinch roller axle passing through and supporting said pinch roller to provide a rotating axis therefor, said pinch roller axle having an internally threaded end adapted to be threadingly secured to said exposed bolt after said nut is removed, said bolt also serving to secure said housing to said first frame member.

4. A mechanism as claimed in claim 3 wherein the length of said pinch roller is sufficiently less than the distance between said frame members to enable some horizontal movement of said pinch roller, on said pinch roller axle, to enable visual alignment of said internally threaded end of said pinch roller axle onto said bolt.

5. A mechanism as claimed in claim 3, wherein said pinch roller has at least one chamfered end to facilitate location of said pinch roller between said frame members.

6. A mechanism as claimed in claim 3, wherein the same end of said pinch roller axle which is internally threaded is chamfered and adapted to be received within said first aperture.

* * * * *